US010709277B2

(12) United States Patent
Baabad

(10) Patent No.: US 10,709,277 B2
(45) Date of Patent: Jul. 14, 2020

(54) PROTECTIVE CASE FOR PHYLACTERIES

(71) Applicant: Yishai Baabad, Beit-El (IL)

(72) Inventor: Yishai Baabad, Beit-El (IL)

( * ) Notice: Subject to any disclaimer, the term of this patent is extended or adjusted under 35 U.S.C. 154(b) by 288 days.

(21) Appl. No.: 15/641,465

(22) Filed: Jul. 5, 2017

(65) Prior Publication Data

US 2019/0008304 A1 Jan. 10, 2019

(51) Int. Cl.

| | |
|---|---|
| ***A47G 33/00*** | (2006.01) |
| ***B65D 43/20*** | (2006.01) |
| ***B65D 25/04*** | (2006.01) |
| ***B65D 43/14*** | (2006.01) |
| ***B65D 85/00*** | (2006.01) |

(52) U.S. Cl.

CPC ..... *A47G 33/008* (2013.01); *A47G 33/00* (2013.01); *B65D 25/04* (2013.01); *B65D 43/14* (2013.01); *B65D 43/20* (2013.01); *B65D 85/70* (2013.01)

(58) Field of Classification Search

USPC ..... 220/525, 259.1, 259.2, 259.4, 259.5

See application file for complete search history.

(56) References Cited

U.S. PATENT DOCUMENTS

| | | | | | |
|---|---|---|---|---|---|
| 221,823 | A * | 11/1879 | Imhaeuser | B65D 43/162 | 220/315 |
| 300,441 | A * | 6/1884 | Borst | B65D 11/00 | 220/520 |
| 1,883,793 | A * | 10/1932 | Johnson | A45D 33/24 | 132/300 |
| 3,006,350 | A * | 10/1961 | Grunfeld | A44C 5/003 | 132/297 |
| 5,947,271 | A * | 9/1999 | Follman | A45C 13/02 | 206/19 |
| 7,828,169 | B2 * | 11/2010 | Robinson | A47F 5/116 | 206/468 |
| 2012/0000799 | A1 | 1/2012 | Adler | | |

* cited by examiner

*Primary Examiner* — Allan D Stevens

(74) *Attorney, Agent, or Firm* — Roach, Brown, McCarthy & Gruber, P.C.; Kevin D. McCarthy

(57) ABSTRACT

A case, for storing two Phylacteries, which prevents the extraction of the head Phylactery before the extraction of the arm Phylactery. The case has a base; a cover; at least one compartment for storing said two Phylacteries; and at least one movable door for covering and uncovering the head phylactery.

3 Claims, 4 Drawing Sheets

PROTECTIVE CASE FOR PHYLACTERIES

TECHNICAL FIELD

The present invention relates to protective cases for Phylacteries. In particular, the present invention relates to protective cases for Phylacteries in conformity with Jewish law and code.

BACKGROUND

For Jewish men, there is a Biblical obligation to wear a set of Phylacteries (also called Tefillin), generally during the morning prayer service. A set of Phylacteries comprises an arm unit, for placement on the arm, and a head unit, for placement on the head. Each Phylactery comprises two major components: a leather box that contains specific portions of the Bible written on parchment and a leather strap (retsua) attached to the box.

Typically, each of the head and arm Phylacteries are generally stored in a shell where both shells are typically stored in a case or bag. Today, the shell is typically made of plastic and has the contours of the Phylactery it stores. Each of the Phylacteries is first stored in its shell and then its leather strap is typically rolled around the shell. As of today, once the phylacteries are stored in their shells, both shells are stored in a case, which is typically made of cloth or any other kind of fabric.

According to the Jewish law, one must wear the arm phylactery first and then wear the head phylactery. Furthermore, according to the Jewish law, one must not lift, touch, or take, the head phylactery before wearing the arm phylactery first (according to some Jewish scholars one must not even pass his hand over the head phylactery before wearing the arm phylactery first). Hence, the Shulchan Aruch (A noted adjudicator for Jewish law) suggested a technical solution for storing the Phylacteries, where the arm phylactery is above the head phylactery and thus when opening the case the first available Phylactery would be the arm phylactery on top, and so agreed the TZ (Turei Zahav—a book of Jewish law). Nevertheless, the Magen Avraham (a Jewish scholar), comments that: since the head phylactery is holier than the arm phylactery, one should not place the arm phylactery above the head phylactery.

US2012000799 discloses a protective shell cover for a Phylactery, including a slot through which a strap of the Phylactery passes when the Phylactery is housed in the shell. The disclosed invention includes an upper shell member and a lower shell member at least partially separable from one another and which, when together, define a hollow interior contoured to fit the Phylactery. Nevertheless, the described protective cover is only for substituting the shell of the Phylactery.

It would therefore be desired to propose a case, for Phylacteries, void of the above mentioned deficiencies and which may comply with all the mentioned opinions of the Jewish scholars mentioned above.

SUMMARY

It is an object of the present invention to provide a case for storing Phylacteries which complies with the above mentioned opinions of the Jewish law.

It is another object of the present invention to provide a case for storing the two Phylacteries side by side while preventing the extracting of the head phylactery before the extracting of the arm phylactery.

It is still another object of the present invention to provide a case for storing Phylacteries which is waterproof.

Other objects and advantages of the invention will become apparent as the description proceeds.

The present invention relates to a case for storing two Phylacteries which prevents the extraction of the head Phylactery before the extraction of the arm Phylactery comprising: (a) a base; (b) a cover; (c) at least one compartment, for storing said two Phylacteries; and (d) at least one movable door for covering and uncovering the head phylactery.

Preferably, the door may uncover the head phylactery only after the arm phylactery has been taken out.

In one embodiment, the door is a sliding door.

In one embodiment, the door is a rotatable door.

In one embodiment, there are two compartments, one for each Phylactery.

In one embodiment, the compartment of the head phylactery is made to receive only the head phylactery.

In one embodiment, the case is water proof.

BRIEF DESCRIPTION OF THE DRAWINGS

The accompanying drawings, and specific references to their details, are herein used, by way of example only, to illustratively describe some of the embodiments of the invention.

In the drawings.

DETAILED DESCRIPTION

The terms of "front", "rear", "down", "up", "bottom", "upper", "horizontal", "vertical", "right", "left" or any reference to sides or directions are used throughout the description for the sake of brevity alone and are relative terms only and not intended to require a particular component orientation.

Hereinafter, parts, elements and components that are depicted in more than one figure are referenced by the same numerals.

Figure 1:
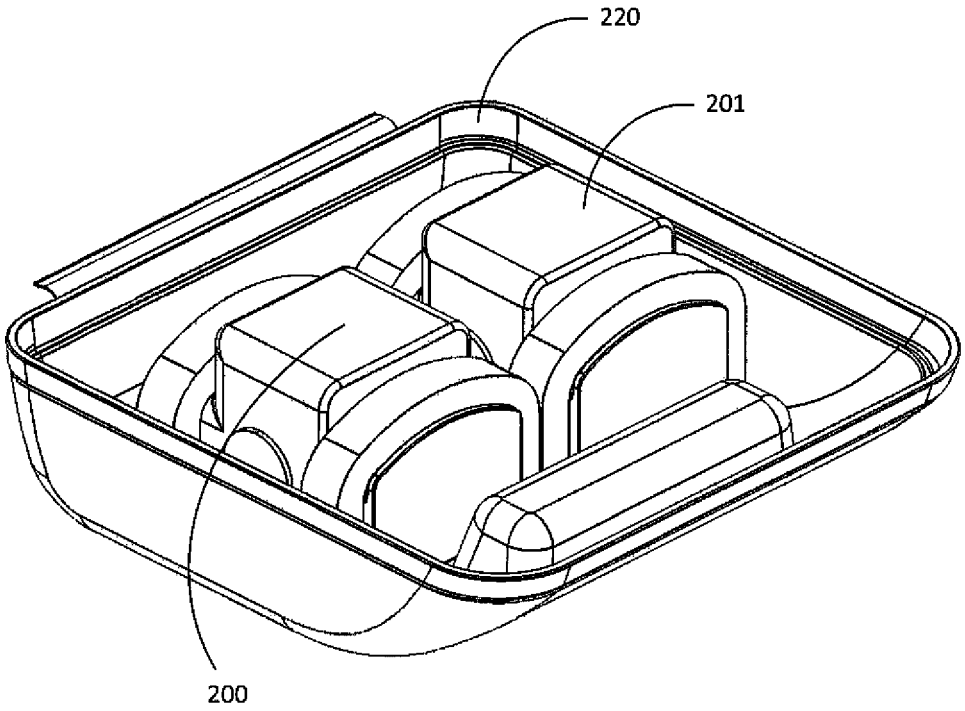
FIG. 1 (PRIOR ART)
FIG. 1 is a diagram of a prior art case for storing Phylacteries.

FIG. 1 is a diagram of a prior art case for storing Phylacteries. In the depicted prior art case, the Phylacteries 200-201 are stored in a case 220. In order to comply with the Magen Avraham's opinion (discussed above), together with the Jewish law that the head Phylactery must not be taken before the arm Phylactery, the Phylacteries are typically stored side by side where the user typically remembers which side each Phylactery has been stored. For example, if the user stored the arm Phylactery 200 on the left side on one day then he will open the case and take the left sided phylactery 200 the day after. Thus, in order to avoid mistakes a user is advised to store the arm Phylactery 200 on the same side each day. Although in the TZ (Turei Zahav a book of Jewish law) it is mentioned that this solution is not correct since it is based on memory and prone to mistakes, and therefore the Phylacteries should be stored in a case where it won't be physically possible to take the head Phylactery first. The TZ suggested storing the Phylacteries in a narrow case where the arm Phylactery is above the head Phylactery and thus when opening the case, the first available Phylactery would be the arm Phylactery on top. Nevertheless, his proposed solution is not practiced today due, among others, to the Magen Avraham's comment above that: since the head Phylactery is holier than the arm Phylactery, one should not place the arm Phylactery above the head Phylactery.

Figure 2:
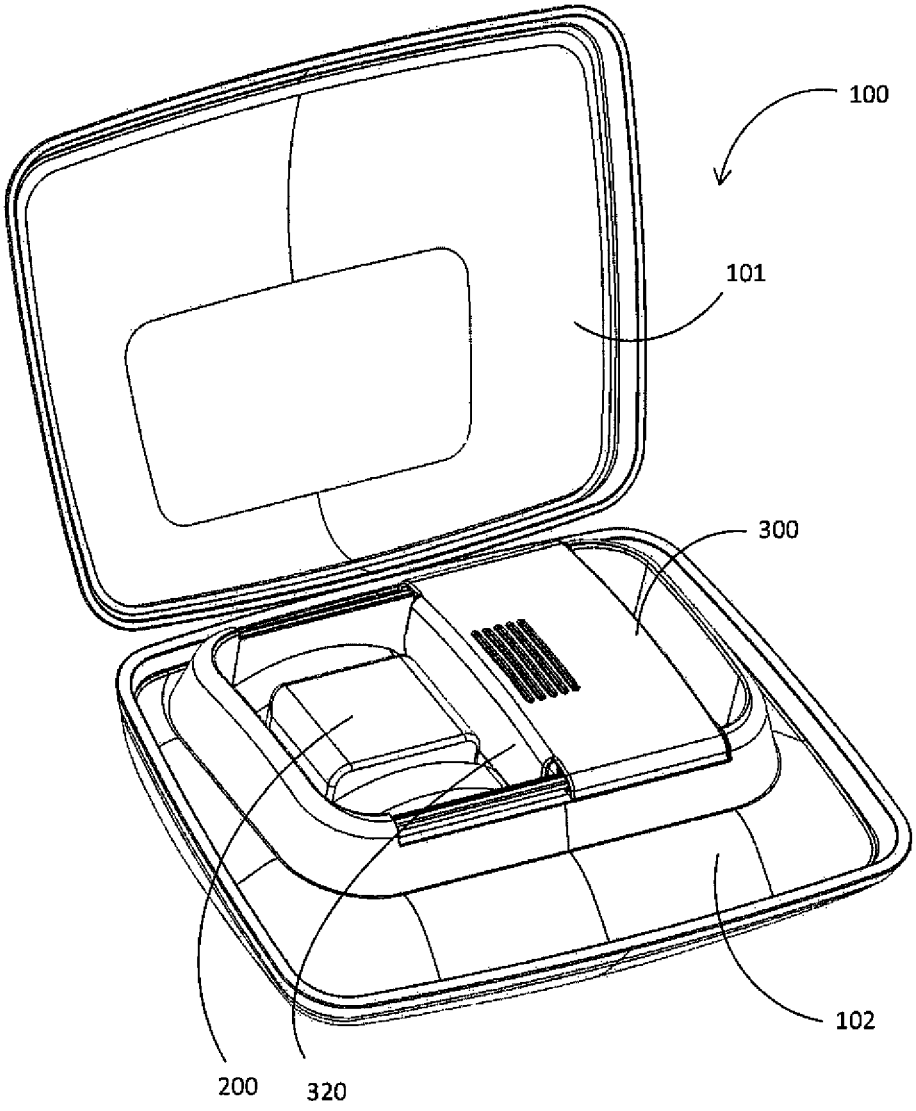
FIG. 2 is a diagram of a case for storing Phylacteries, according to an embodiment of the invention.

FIG. 2 is a diagram of a case for storing Phylacteries, according to an embodiment of the invention. In this embodiment, a special sliding door 300 covers the head Phylactery for physically preventing the user from taking the head Phylactery first. When the user wishes to wear a set of Phylacteries he can open the cover 101 of the case 100. The cover 101 and/or the base 102 of the case 100 may be made of rigid materials, such as resin, plastic, or metal, or from non-rigid materials, such as fabric or cloth, or from any combination of materials such as plastic covered by cloth or any other known material or known combination. After opening the cover 101 of the case 100 the user can only take out the arm Phylactery 200. It should be mentioned that, although the cover 101 has been opened, the head Phylactery is still covered by the sliding door 300, effectively complying with the opinions of the TZ and complying with other opinions that the head Phylactery should not be visible until the arm Phylactery has been worn. The sliding door 300 may have a knee bent with a fence 320 which prevents the sliding door from moving as long as the arm Phylactery is present.

Figure 3:
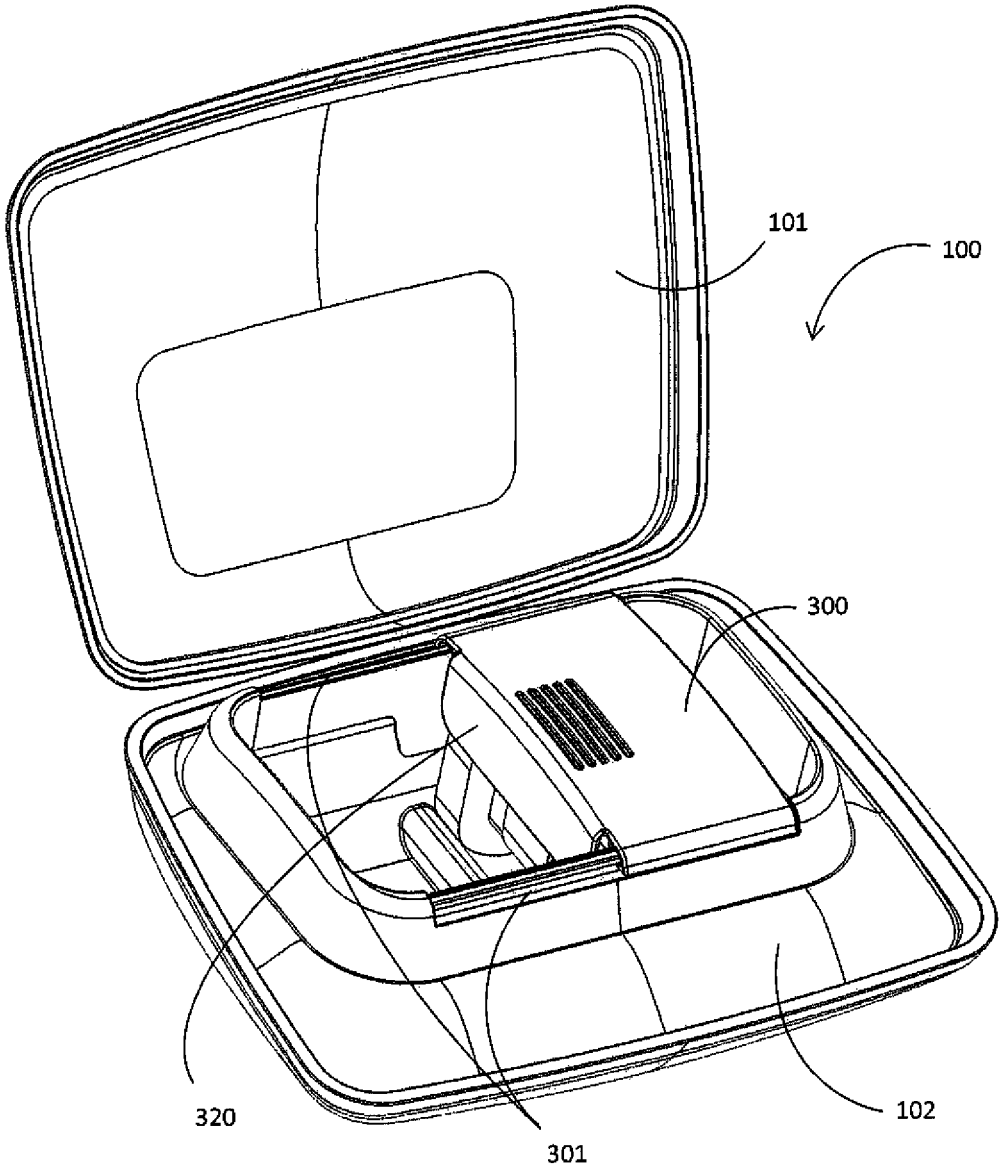
FIG. 3 is a diagram of a case for storing Phylacteries, after the arm Phylactery has been taken out, according to an embodiment of the invention.

FIG. 3 is a diagram of a case for storing Phylacteries, after the arm Phylactery has been taken out, according to an embodiment of the invention. As described in relations to FIG. 2, the sliding door 300 may have a knee bent with a fence 320 which prevents the sliding door from moving as long as the arm Phylactery is present. However, once the arm Phylactery has been taken, the sliding door 300 may be moved to the left, over the sliding rails 301, since there is nothing that prevents the fence 320 from moving leftwards.

Figure 4:
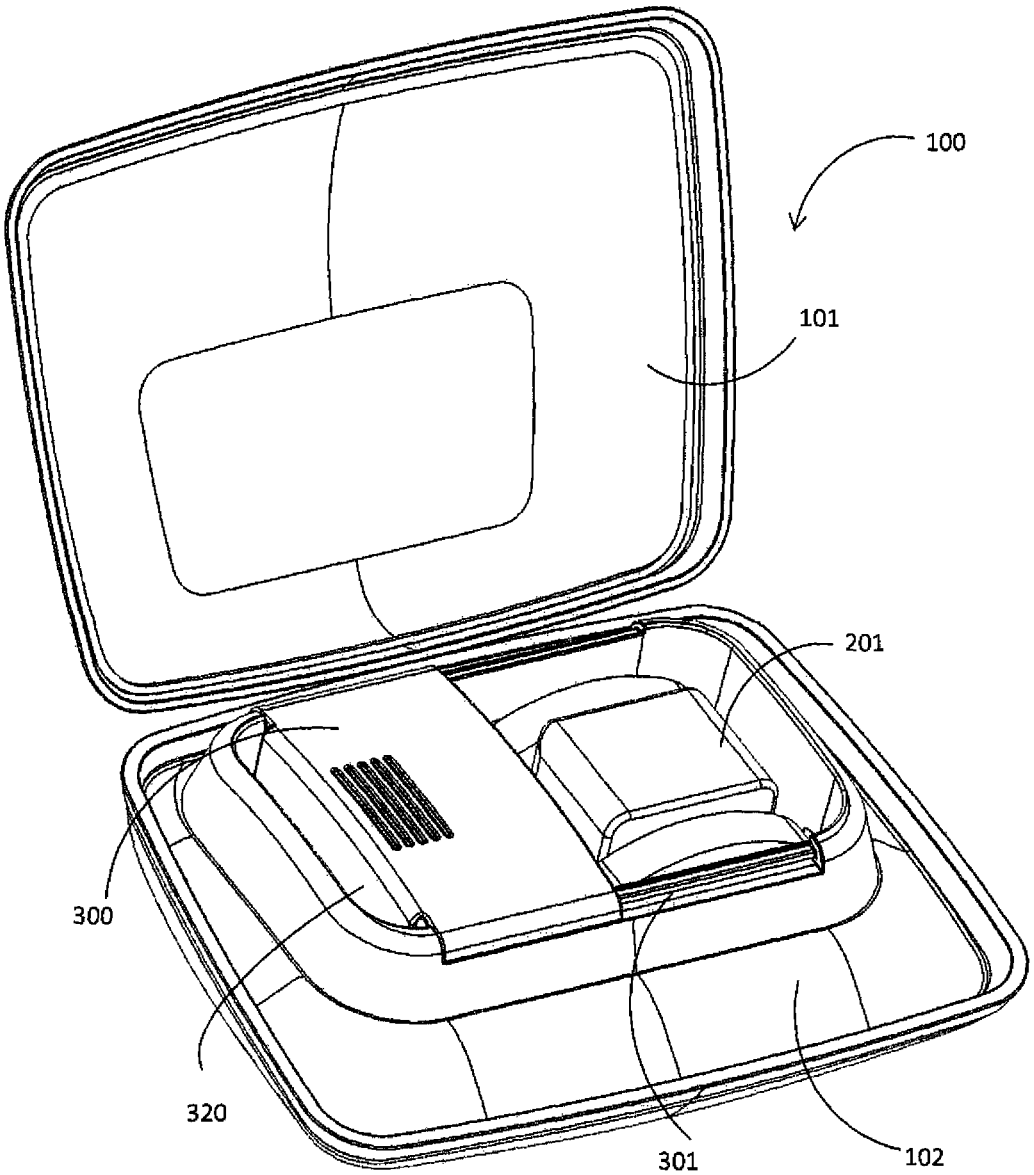
FIG. 4 is a diagram of a case for storing Phylacteries, after the sliding door has been moved to the left, according to an embodiment of the invention.

FIG. 4 is a diagram of a case for storing Phylacteries, after the sliding door has been moved to the left, according to an embodiment of the invention. As depicted in the diagram, the sliding door 300 has been moved to the left after the arm Phylactery has been taken, and now the head Phylactery is visible and the user may take the head Phylactery. Thus, the case, according to an embodiment, may have a cloth cover, as traditionally used for storing the Phylacteries, while preventing the extracting of the head Phylactery before the extracting of the arm Phylactery.

When the user takes off the Phylacteries he is required to take off the head Phylactery first, according to the Jewish law. Thus after the user takes off the head Phylactery, and rolls its leather straps, he my put the head Phylactery in its place, slide the sliding door right, after which the user takes off the arm Phylactery, and rolls its leather straps and then puts the arm Phylactery inside the case 100.

In one embodiment the case may have one single compartment for accommodating both Phylacteries in their shells. In another embodiment the case may have two compartments each for accommodating one Phylactery and its shell. In one embodiment each of the Phylacteries' compartments in the case may be specifically designed for accommodating a specific Phylactery and its shell in order to prevent the user from putting the wrong Phylactery in the wrong place. In one embodiment the left compartment 2-34 is designed for accommodating the arm Phylactery 200, while the right compartment 235 is designed for accommodating the head Phylactery 201. In another embodiment the case may have one single compartment designed for accommodating the arm Phylactery, and its shell, in its left side while accommodating the head Phylactery and its shell in its right side.

In one embodiment, the shell of the arm Phylactery is designed to be higher than the shell of the head Phylactery so as to prevent the user from sliding the door over the arm Phylactery if mistakenly placed in the compartment of the head Phylactery. In one embodiment a puffy sticker, or any height adding add-on, is added to the shell of arm Phylactery in order to heighten the shell of the arm Phylactery so as to prevent the user from sliding the door over the arm Phylactery if mistakenly placed in the compartment of the head Phylactery.

In one embodiment the disclosed door may be a rotatable door; instead of a sliding door where the door may have an axle instead of sliding rails. In this embodiment, the door may be present over the head Phylactery 201, on one hand, to hide the head Phylactery at first when the arm Phylactery 200 is taken and then may be rotated to the left to reveal the head Phylactery 201 on the other hand. Other types of doors may be used as well such as removable, swivel, etc.

In one embodiment the case is also waterproof for protecting the Phylacteries. The technology for building waterproof cases is well known in the art, such as making a plastic case where the cover may be fastened, using clips or any other fastening means, to the base, of the case, with a rubber sealing in between. Thus, according to an embodiment of the invention, a waterproof case may be made, for storing two Phylacteries, which prevents the extracting of the head Phylactery before the extracting of the arm Phylactery.

In one embodiment, the case may be water-resistant for protecting the Phylacteries from the rain, for example. The technology for building water-resistant cases is well known in the art, such as making a case from water-resistant materials having a water-resistant closing, e.g. water-resistant zipper for example.

Other cases and embodiments may be possible as well for hiding the head Phylactery, on one hand, and then revealing the head Phylactery on the other hand after the arm Phylactery is taken.

While the above description discloses many embodiments and specifications of the invention, these were described by way of illustration and should not be construed as limitations on the scope of the invention. The described invention may be carried into practice with many modifications which are within the scope of the appended claims.

The invention claimed is:

1. A case in combination with a head Phylactery and an arm Phylactery; the case comprising:

a base;

a compartment configured to accommodate the arm Phylactery and the head Phylactery;

an openable cover, for opening said case and revealing the arm Phylactery while the head Phylactery is covered by a moveable door; and the movable door has a fence and the moveable door is configured to (a) cover the head Phylactery and have the fence positioned between the arm Phylactery and the head Phylactery when the arm Phylactery is positioned in the compartment and (b) uncover the head Phylactery only after the arm Phylactery is taken out from the compartment;

wherein the movable door (a) hides the head Phylactery in the compartment when the arm Phylactery is present in said compartment, (b) can be moved only after the arm Phylactery is taken out from the compartment, (c) reveals the head Phylactery in the compartment only after the arm Phylactery is taken out from the compartment and the moveable door is moved, and (d) physically prevents a user from removing the head Phylactery from the compartment before the arm Phylactery is removed from the compartment.

2. The combination according to claim 1, where the case is waterproof.

3. The combination according to claim 1, wherein the moveable door is a sliding door.

* * * * *